US006346960B1

(12) United States Patent
Kanakubo et al.

(10) Patent No.: US 6,346,960 B1
(45) Date of Patent: Feb. 12, 2002

(54) THERMAL HEAD DRIVING INTEGRATED CIRCUIT

(75) Inventors: Yoshihide Kanakubo; Yasuhiro Moya; Tatsuya Kitta; Kazutoshi Ishii; Sumitaka Goto, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/404,936

(22) Filed: Sep. 23, 1999

(30) Foreign Application Priority Data

Sep. 24, 1998 (JP) ..... 10-270202

(51) Int. Cl.[7] ..... B41J 2/345
(52) U.S. Cl. ..... 347/211
(58) Field of Search ..... 347/211, 210, 347/59, 180, 181, 182, 120.06, 209, 200; 400/120.05, 124.11

(56) References Cited

U.S. PATENT DOCUMENTS 5,786,839 A * 7/1998 Itoh ..... 347/211

* cited by examiner

*Primary Examiner*—N. Le
*Assistant Examiner*—K. Feggins
(74) *Attorney, Agent, or Firm*—Adams & Wilks

(57) ABSTRACT

A thermal head driving integrated circuit may be used to perform an "n" color or "n" gradation printing operation with a simplified circuit having a reduced size by employing a single delay element connected to a plurality of resistive heating elements. The integrated circuit has a plurality of drive units each for driving a respective one of the heating elements and each having a drive transistor for driving a respective heating element, one or more delay elements, the number of delay elements being less than "n", for supplying delayed print data to the drive transistor, a print data storing unit for storing the print data of each of the "n" types, and a print data supplying unit for supplying print data stored in the print data storing unit to the "n" delay elements.

23 Claims, 6 Drawing Sheets

THERMAL HEAD DRIVING INTEGRATED CIRCUIT

BACKGROUND OF THE INVENTION

1. Field of the Invention

The present invention generally relates to a thermal head driving integrated circuit (IC). More specifically, the present invention is directed to a thermal head driving circuit capable of performing a multi-color printing operation by setting plural sets of energizing time with respect to respective heating resistive elements.

2. Description of the Related Art

While various sorts of office automation (OA) appliances such as personal computers (PCs) and word processors have been popularized, printers using thermal heads are widely utilized as printers for printing out documents and images formed by these OA appliances.

When a thermal head is employed so as to print, for example, on an A4-sized paper in a line sequential manner, the thermal head is provided with 1,728 heating resistive elements arranged along one column. Then, while the entire heating resistive elements are subdivided into plural element blocks for every 64 heating resistive elements, the heating resistive elements belonging to each of these sub-divided blocks are controlled by an ON/OFF control mode (namely energizing/energizing-stop control mode) by employing thermal head driving integrated circuits for every block.

FIG. 5 is a circuit diagram for indicating a drive unit which may control the ON/OFF state of one heating resistive element in such a thermal head driving integrated circuit.

As indicated in this drawing, a drive unit of a heating resistive element 100 is provided with a drive transistor 200 and a 2-input AND gate circuit 300. The output terminal of this AND gate circuit 300 is connected to the gate of the drive transistor 200, the driver output terminal DO1 of the AND gate circuit 300 is connected to the drain of this drive transistor 200, and also, all of the source terminals are connected to the ground potential. One terminal of this heating resistive element 100 for printing one dot is connected to the driver output terminal DO1.

To one input terminal of the AND gate circuit 300, a data signal DAT is supplied via a shift register (not shown) and a latch circuit (not shown either) with respect to each of the data bits, whereas a strobe signal STB commonly applied to the other AND gate circuits is supplied to the other input terminal of this AND gate circuit 300.

In accordance with such a drive unit, when either data DAT "1" (H level) or data DAT "0" (L level) produced based upon print data is supplied from the latch circuit to the AND gate circuit 300, the strobe signal STB is supplied at predetermined timing, so that the level of the signal becomes an H level. As a result, the level of the output signal from the AND gate circuit 300 to which the data DAT "1" has been supplied is brought into an H level, so that the drive transistor 200 is turned ON. While the strobe signal STB is supplied to this AND gate circuit 300, the heating resistive element 100 is energized to perform a printing operation.

On the other hand, in the case that the AND gate circuit 300 is turned ON/OFF in the drive unit shown in FIG. 5, if a voltage signal having a sharp rising edge, or a voltage signal having a sharp falling edge is applied to the gate of the drive transistor 200, then an overshoot, or an undershoot phenomenon appears in the drain voltage of this drive transistor 200. As a result, the drive transistor 200 must have such a maximum rating voltage capable of withstanding this overshoot of the drain voltage. Similarly, such an overshoot or an undershoot phenomenon appears even in a bipolar IC, or a single channel MOS. After all, in any cases, the drive transistor 200 must have a maximum rating voltage capable of withstanding the overshoot voltage.

Under such a circumstance, in the conventional AND gate circuit 300, the internal circuit thereof is constructed in such a manner that a channel length, also referred to as an L-length, of a circuit side to which the ON/OFF-controlling strobe signal STB is supplied is made long. Thus, since the rising operation of this AND gate circuit 300 is delayed, the overshoot voltage is suppressed.

On the other hand, another case may be conceived. That is, a printing operation of plural gradation levels may be carried out, or a printing operation of plural colors may be performed by employing a single heating resistive element 100 for printing out 1 dot. In other words, by employing an integer "n" different the energizing times for one heating resistive element 100 so that n different colors or gradations may be produced, color development density may be varied. Otherwise, when recording paper is used which may develop different colors in response to heating thermal energy amounts defined by energizing time, the multi-color printing operation is carried out.

FIG. 6 represents both a drive unit and the heating resistive element 100, in which such a 2-color printing thermal head driving IC is realized by using the conventional 1-color printing thermal head driving IC.

FIG. 6(*a*) shows a circuit in which two sets of AND gate circuits 300*r* and 300*b* are connected to the gate of the drive transistor 200 connected to a single heating resistive element 100. Similar to the AND gate circuit 300 indicated in FIG. 5, both the AND gate circuits 300*r* and 300*b* are arranged as follows: to suppress an overshoot phenomenon, L-lengths of sides to which strobe signals STBr and STBb are supplied are made long.

As explained above, although the output signals of both the AND gate circuits 300*r* and 300*b* are directly supplied to the gate of the drive transistor 200, since the rising edges of the strobe signals STBr and STBb are suppressed, the overshoot phenomenon can be suppressed.

FIG. 6(*b*) shows another circuit in which a 2-input OR gate circuit is connected to the gate of the drive transistor 200, and AND gate circuits 301*r* and 301*b* are connected to the respective input terminals of this 2-input OR gate circuit. In this case, L-lengths of the AND gate circuits 301*r* and 301*b* on both input sides are not made long, but normal AND gate circuits are used.

On the other hand, the OR gate circuit 310 connected to the gate of the drive transistor 200 is so arranged that L-lengths of both input sides thereof are made long. As a result, although both the signals outputted from the AND gate circuits 301*r* and 301*b* have sharp rising edges, the sharp rising edges are delayed by this OR gate circuit 310 in which the L-lengths of the input sides are made long. As a result, the transistor 200 is driven under such a condition that the overshoot phenomenon is suppressed.

In the drive unit having such a circuit arrangement, since the output time of the strobe signal STBr and the output time of the strobe signal STBb are separately set, the pulse width of the pulse signal applied to the gate of the drive transistor 200 may be adjusted. As a result, the time when the drive transistor 200 is turned ON, and also the heating time defined by the heating resistive element 100 is changed, so that the printing operations of the plural gradation and also the multi-color printing may be carried out.

For instance, when such a recording paper is used where a red color is developed by energizing the heating resistive element 100 for a short time period and also a black color is developed by energizing the heating resistive element 100 for a long time period, while the print data DATr for developing the red color is supplied, such a strobe signal STBr having a short pulse width is supplied. As a result, a red color contained in one line is printed out. On the other hand, while the print data DATb for developing the black color is supplied, such a strobe signal STBb having a long pulse width is supplied. As a consequence, a black color contained in the same one line is printed out.

On the other hand, when either an AND gate circuit or an OR gate circuit is provided, if this gate circuit is arranged in such a manner that an L-length is made long, then a circuit size of this gate circuit is increased. As a consequence, both the drive units shown in FIG. 6(*a*) and FIG. 6(*b*) require two sets of such structural portions whose L-lengths are made long. Therefore, there is a problem in that the entire size of this drive unit is increased. In particular, when an n-gradation control operation is carried out and an n-color printing operation is performed, L-lengths at each of the "n" portions must be made long, and furthermore, the circuit sizes must be considerably increased.

Also, since the delay time caused by the L-lengths at the two portions is different from each other, the switching speeds of the drive transistor 200 with respect to the same dot are made different as to the print data DATr and the print data DATb. As a consequence, as to the gradation control operation and the color control operation (PWM=controlled by pulse width), there is another problem that the gradation for every dot (bit) is made ununiform.

SUMMARY OF THE INVENTION

Accordingly, an object of the present invention is to provide a thermal head driving integrated circuit capable of suppressing an increase of a circuit size even when a plural-gradation printing operation and/or a multi-color printing operation are carried out by employing a single heating resistive element. Also, another object of the present invention is to provide such a thermal head driving integrated circuit capable of energizing such a single heating resistive element with the same delay time with respect to gradation and/or each of colors in the same bit.

To achieve the above-described object, a thermal head driving integrated circuit according to an aspect of the present invention is featured by comprising: a plurality of drive units each in correspondence with a respective one of the respective heating resistive elements, wherein each of the drive units is comprised of a drive transistor for controlling the energizing operation of the corresponding heating resistive element in response to the supplied print data; used for energizing the heating resistive elements for an integer number "n" of different durations to produce n different print types such as gradations or colors; a plurality of delay means, the plurality being less than "n", for delaying the print data to supply the delayed print data to the drive transistor; "n" print data bit storing means for storing "n" bits of supplied print data with respect to each of the "n" print types; and "n" print data bit supplying means for supplying the print data saved in the corresponding print data storing means to the delay means.

As a consequence, since a total number of delay means is selected to be less than "n", or preferably 1, the entire size of the integrated circuit can be reduced. Also, since a single delay element is commonly used as to plural sorts of print data, the printing qualities as to the commonly used print data can be made uniform.

Further, in the thermal head driving integrated circuit of the present invention, the drive transistor is an enhancement type FET, and the delay means is an 1-input/1-output logic circuit, the L-length of which is made long.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERRED EMBODIMENTS

Referring now to FIG. 1 through FIG. 4, various preferred embodiments of the present invention as to a thermal head driving integrated circuit will be described in detail.

(1) Conceptual Structure of Embodiment Mode

In this embodiment mode, a single delay element (delay means) is directly connected to the respective gates of drive transistors for controlling energizations of the respective heating resistive elements. Then, print data DATr and DATb per 1 bit are supplied to the commonly-connected delay element, and are selectively outputted in response to a strobe signal STBr and another strobe signal STBb.

Concretely speaking, as this delay element, an inverter, the L-length of which is made long, is used. An output terminal of a NOR gate circuit is connected to this inverter. Then, in response to the strobe signals STBr and STBb, both the print data DATr and DATb are entered into two input terminals of the NOR gate circuit.

As a result, since the delay element per 1 bit may be commonly used, only one delay element may be provided. Also, output delay time of print data in each bit is made equal to each other with respect to each gradation and each color. In other words, the switching speeds of the respective drive transistors are made equal to each other with respect to the respective gradation and the respective colors, so that printing qualities can be improved.

(2) Detailed Circuit Arrangement of Embodiment Mode

Figure 1:
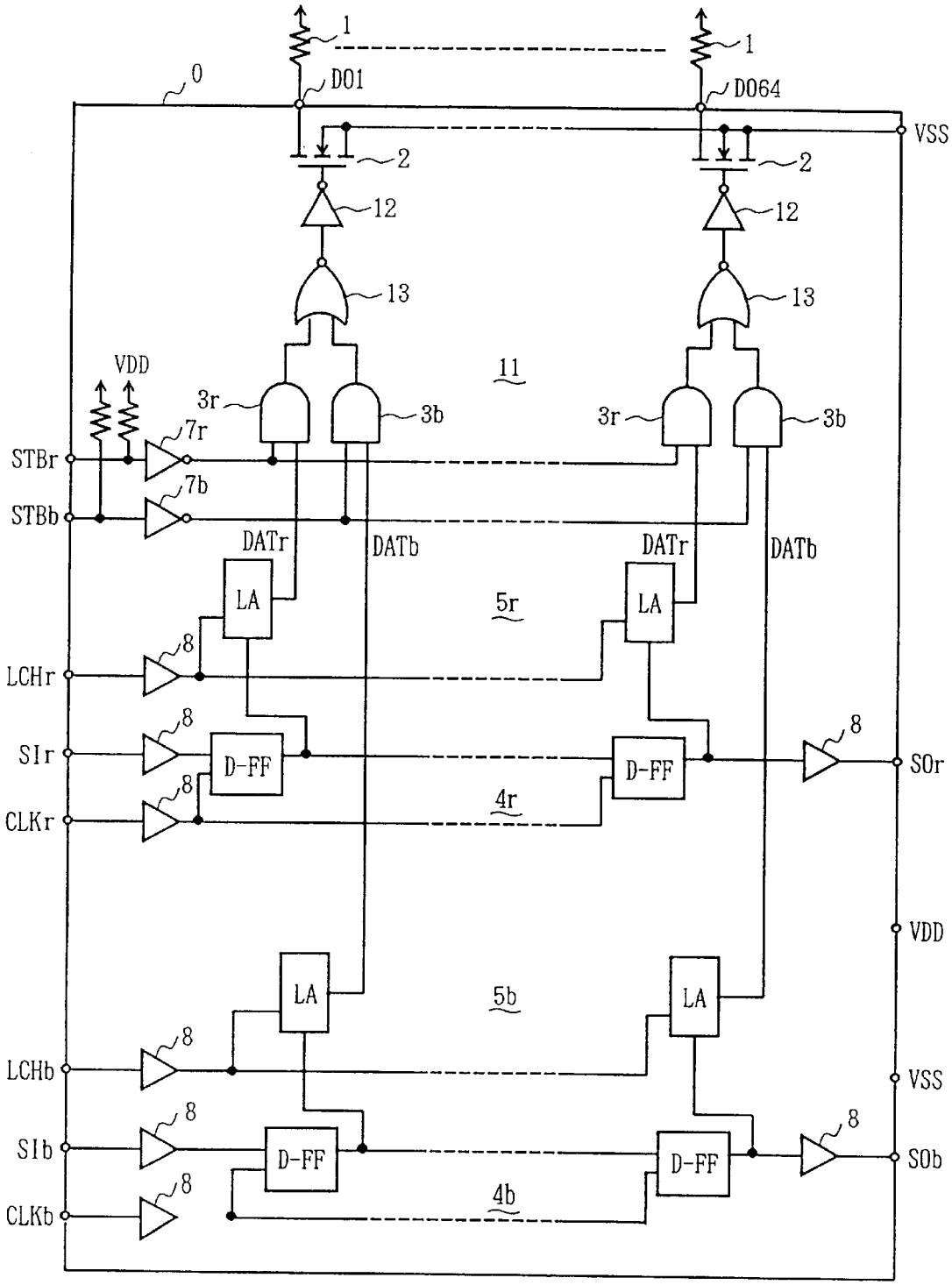
FIG. 1 is a schematic block diagram for showing a circuit arrangement of a thermal head driving integrated circuit (IC) according to an embodiment of the present invention.

FIG. 1 is a block diagram for representing a circuit arrangement of a thermal head driving integrated circuit (IC) according to an embodiment of the present invention.

This thermal head driving integrated circuit 0 is integrated in a semiconductor chip, and is used to control energization of a plurality of heating resistive elements 1 which constitute a thermal head in response to print data. Then, in this embodiment, 2-color printing operation is available. Now, a description will be made of a thermal head driving IC in such a case that two-color printing operation of red and black colors is carried out by using a suitable recording paper. That is, a red color is developed for energizing time "t1", and a black color is developed for energizing time "t2 (t2>t1)" in this recording paper.

As indicated in FIG. 1, the thermal head driving IC 0 is provided, as an external terminal, with driver output terminals DO1 to DO64; a power supply terminal VDD; a ground terminal VSS; print data input terminals SIr, SIb; print data output terminals SOr, SOb; and further various sorts of control terminals STBr, STBb, LCHr, LCHb, CLKr, CLKb.

As an internal circuit, this thermal head driving IC 0 employs a drive unit 11, a shift register unit 4 (including 4*r* and 4*b*), and a latch unit 5 (including (5*r* and 5*b*). The drive unit 11 functions as a driver for driving the thermal head. The shift register unit 4 sequentially transfers print data which are supplied in a serial mode, and saves thereinto these print data. The latch unit 5 latches the print data saved in the shift register unit 4. In this embodiment mode, D-FF (D type flip-flop) and a latch element LA provided in each stage of the shift register unit 4 and the latch unit 5 will function as a print data saving means.

The drive unit 11 contains 64 sets of a drive transistor 2, an inverter 12, a NOR gate circuit 13, and two AND gate circuits 3*r*, 3*b* and two inverters 7.

In each of the drive transistors 2, an enhancement type FET is used. The respective drive transistors 2 are open-drain-connected to the respective driver output terminals DO1 to DO64. 64 (in total) heating resistive elements 1 are connected to these driver output terminals DO1 to DO64. All of the sources of the respective drive transistors 2 are connected to the ground potential VSS.

Also, the output terminal of the inverter 12 functioning as a delay means is connected to the gate of each of the drive transistors 2, and the 2-input NOR gate circuit 13 is connected to the input terminal of the inverter 12. This delay means is arranged in such a manner that an L-length is made long. Both an output terminal of the AND gate circuit 3*r* for printing out a red color and an output terminal of the AND gate circuit 3*b* for printing out a black color are connected to the respective input terminals of the NOR gate circuit 13.

A first input terminal of each of the 64 AND gate circuits 3*r* is commonly connected via an inverter 7*r* to a control terminal STBr. Similarly, a first input terminal of each of the 64 AND gate circuits 3*b*is commonly connected via another inverter 7*b* to another control terminal STBb. It should be noted that the control terminals STBr and STBb are pulled-up to the power supply VDD.

All of second input terminals of the respective AND gate circuits 3*r* are connected to the respective stages corresponding to the latch circuits 5*r*. All of second input terminals of the respective AND gate circuit 3*b* are connected to the respective stages corresponding to the latch circuits 5*b*.

In this embodiment, the above-described NOR gate circuit 13, AND gate circuits 3*r*/3*b*, inverters 7*r*/7*b*, and strobe input terminals STBr/STBb will constitute a print data supplying means.

The shift register unit 4 is provided with a shift register 4*r* and another shift register 4*b*. The shift register 4*r* sequentially stores thereinto 64-bit red data among the print data for 1 line. The shift register 4*b* sequentially stores thereinto 64-bit black data among the print data for 1 line. Each of these shift registers 4*r* and 4*b* is constituted by 64 D-FFs series-connected to each other.

These shift registers 4*r* and 4*b* are connected via buffers 8 to a red data input terminal SIr and a black data input terminal SIb. A final stage of each of these shift registers 4*r* and 4*b* is connected via the buffers 8 to a red data output terminal SOr and a black data output terminal SOb, respectively.

Also, the respective stages of the shift registers 4*r* and 4*b* are commonly connected via the buffers 8 to the control terminals CLKr and CLKb, to which clock signals are supplied.

In response to the rising edges of the clock signals applied to the control terminals CLKr and CLKb, the shift registers 4*r* and 4*b* sequentially read therein the print data signals inputted to the data input terminals SIr, and SIb, and furthermore, shift the previously read print data, namely the print data which have been saved in the D-FFS.

The latch unit 5 is equipped with a latch circuit 5*r* for latching red data, and another latch circuit 5*b* for latching black data. Each of these latch circuits 5*r*/5*b* is constituted by 64 latch elements LA. The outputs of the respective stages are connected to the second input terminals of the AND gate circuits 3*r*/3*b* corresponding thereto.

These latch circuits 5*r* and 5*b* are commonly connected via the buffers 8 to the control terminals LCHr and LCHb, to which the latch signals are supplied.

When the control terminals LCHr and LCHb are at L-levels, the latch circuits 5*r* and 5*b* latch the print data in a batch mode. The print data are stored into the stages corresponding to the shift registers 4*r* and 4*b*. To the contrary, when the control terminals LCHr and LCHb are at H-levels, the latch circuits 5*r* and 5*b* hold the print data which have been latched immediately before, and then supply the held print data to the second input terminals of the corresponding AND gate circuits 3*r* and 3*b*.

2-Color Printing Operation by Thermal Head Driving IC

Next, two-color printing operation by red and black colors by employing the thermal head driving IC with employment of the above-described circuit arrangement will now be explained.

When a red color contained in 1 line is printed out, 64-bit red data are supplied from the control terminal SIr to thermal head driving IC 0 in the serial data mode. Then, every time the clock signal is supplied from the control terminal CLKr, when the 64-bit red data are sequentially stored into the shift register 4*r* while these red data are sequentially shifted via the D-FFs along the direction of the output terminal SOr, the latch signal is supplied from the control terminal LCHr. As a result, the 64-bit red data are latched to the latch circuit 5*r* in the batch mode, and are continuously supplied to the AND gate circuit 3*r* for the red data employed in the drive unit 11 until the next latch signal LCHr is supplied.

Then, when the strobe signal STBr having the L-level is supplied at predetermined timing for a time period of "T1", this strobe signal is inverted by the inverter 7*r*, so that the signal having the H-level is supplied to the AND gate circuit 3*r*. This time period "T1" is equal to "t1+" where symbol " " indicates time caused by a delay in a rising edge. Thus, the red data which is supplied from the corresponding stage of the latch circuit 5*r* is outputted from the AND gate circuit 3*r*. It should be noted that the strobe signal STBb for the black data is not outputted during the above-described operation. As a result, no black data is outputted from the AND gate circuit 3*b*.

When the red data is outputted from the AND gate circuit 3*r*, this red data is inverted by the NOR gate circuit 13. Thereafter, this inverted red data is again inverted by the inverter 12, and then the resulting red data is outputted to the gate of the drive transistor 2.

In other words, in the case that the signal level of the red data supplied from the latch circuit 5*r* provided in each stage is equal to an H level, a signal having an H-level is outputted from the inverter 12 by receiving the strobe signal STBr. As a result, the drive transistor 2 is turned ON, and therefore the corresponding heating resistive element 1 of the thermal head is energized only for the time "t1", so that the red color is printed out. As previously explained, since the red data used to drive the drive transistor 2 is finally delayed and outputted from the inverter 12 whose L-length is made long, the rising edge of the gate voltage applied to the drive transistor 2 is suppressed, and furthermore, the overshoot phenomenon is suppressed.

On the other hand, such a drive transistor 2 for a bit where a signal level of red data is an L-level is brought into an OFF state.

While the drive unit 11 drives the thermal head to print out the red data in response to the strobe signal STBr, a process operation for printing out a black color with respect to the same line is carried out.

That is, 64-bit black data are supplied from the control terminal SIb in the serial mode, and then are sequentially stored into the shift register 4*b* while being sequentially shifted via the D-FFs in response to the clock signal CLKb. Thereafter, the 64-bit black data are latched to the latch circuit 5*b* in a batch mode in response to the latch signal LCHb, and then are continuously supplied to the corresponding AND gate circuit 3*b* for the black data until the next latch signal LCHb is supplied.

When the above-described black data printing operation and red data printing operation are accomplished, similar to the red data printing operation, black data is outputted from the AND gate circuit 3*b* for the black data in such a case that the strobe signal STBb having the L-level is supplied at predetermined timing only for a time period "T2" (namely, T2=t2+). Then, when the black data having the H-level is outputted from this AND gate circuit 3*b*, this black data is interved by the NOR gate circuit 13. Thereafter, this inverted black data is again inverted by the inverter 12, and also is raised while being delayed. The resultant black data is supplied to turn ON the drive transistor 2. This drive transistor 2 energizes the heating resistive element 1 only for a time period "t2" corresponding to the strobe signal STBb= T2. As a consequence, the black color is printed on the recording paper.

It should be understood that since the above-explained rising delay time " " go when the red data is printed out is equal to that when the black data is printed out in the present invention, the effective control times "t1" and "t2" used to control the heating resistive element 1 uniformly become shorter than the control time "T1" and "T2", and there are no time fluctuations with respect to the red data and the black data.

After the red data printing operation and the black data printing operation are carried out, 64 bit data of 1 line have been printed out. Then, either the recording paper or the thermal head is moved for 1 line by the drive unit (not shown), and then, the printing operation is similarly carried out as to the next line.

As previously explained, in the thermal head driving IC 0 according to this embodiment, the shift registers 4 and the latch circuits 5, which save the print data supplied in the serial manner, are subdivided into the two circuit systems for the red data and the black data. In response to the strobe signals STBr and STBb, having the different output time (pulse widths) from each other, the black and red data are outputted from the AND gate circuits 3*r* and 3*b*.

Then, both the red data outputted from the AND gate circuit 3*r* and the black data outputted from the AND gate circuit 3*b* are outputted from the common output terminal of the 2-input NOR gate circuit 13. Furthermore, these black and red print data are outputted from the same delay element, namely the 1-input inverter 12 so as to control the ON/OFF state of the drive transistor 2.

As previously explained, in the thermal head driving IC 0 of this embodiment, since the print data for two colors are outputted from the same delay element so as to drive the drive transistor 2, the delay time for energizing the respective heating resistive elements 1 can be made equal to each other with respect to the respective colors.

Also, in the thermal head driving IC 0 of this embodiment, only one inverter 12 functioning as the delay element is used. Then, this single inverter 12 is arranged in such a manner that one input terminal is provided and the L-length for this input is made long. As previously explained, in accordance with this embodiment mode, since there is one portion having the long L-length, it is possible to prevent from increasing the chip size of the thermal head driving.

Modifications

While the circuit arrangement and the operation of the thermal head driving IC 0 according to this embodiment have been described, the present invention is not limited thereto, but may be freely modified within the technical scope defined by the pending claims.

For example, in the above-described printing operation of the embodiment, the red-data read timing is shifted from black-data read timing. Alternatively, both the reading operation of the red data into the shift register 4*r* and also the reading operation of the black data into the shift register 4*b* may be carried out at the same timing, and furthermore, the red-data latching operation to the latch circuit 4*r* and the black-data latching operation to the latch circuit 4*b* may be carried out at the same timing. To this end, while the clock signals CLKr and CLKb of the shift registers 4*r* and 4*b* are commonly used, the latch signals LCHr and LCHb may be commonly used. As a result, a total number of input terminals may be decreased.

As a consequence, both the red data and the black data are supplied to the AND gate circuit 3*r* and the AND gate circuit 3*b* at the same timing, respectively. Then, since the output timing of the red-data strobe signal STBr is shifted from the output timing of the black-data strobe signal STBb (namely, alternatively outputted), both the read data and the black data of the same line may be separately printed out. While this red data is printed out and thereafter the black data is printed out, the red and black data are read into the shift registers 5*r* and 5*b*.

Also, in the thermal head driving IC 0 as explained in FIG. 1, the inverter 12 is used as the delay element. Alternatively, other delay elements may be employed.

Figure 2:
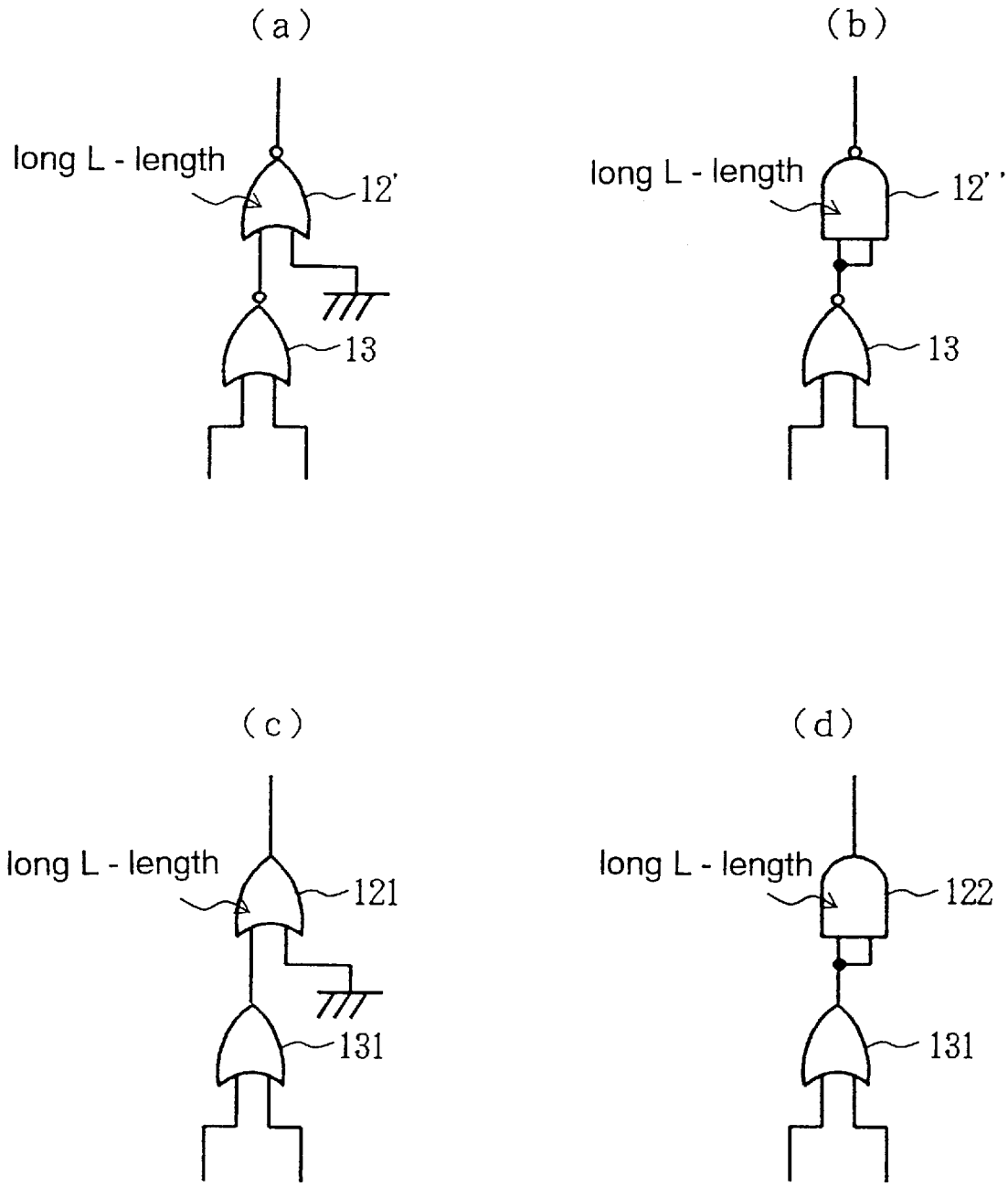
FIG. 2 is a circuit diagram for showing structures of other delay elements employed in the thermal head driving IC of FIG. 1.

FIG. 2 represents circuit arrangements in the case that other delay elements are employed.

In FIG. 2(*a*), a 2-input NOR gate circuit 12' is employed, instead of the inverter 12 functioning as the delay element. In this case, the 2-input NOR gate circuit 12' is arranged such that an L-length as to a first input terminal is made long. In this case, the NOR gate circuit 12' may function as the inverter in such a way that the first input terminal having the long L-length is connected to the output terminal of the NOR gate circuit 13, and another input terminal is commonly connected to the ground terminal GND.

In FIG. 2(*b*), a 2-input NAND gate circuit 12" is employed, instead of the inverter 12 functioning as the delay element. In this case, the 2-input NAND gate circuit 12" is arranged such that an L-length as to a first input terminal is made long. In this case, the NAND gate circuit 12" may function as the inverter in such a way that the first input terminal having the long L-length is connected to the output terminal of the NOR gate circuit 13, and another input terminal is connected to the first terminal.

FIG. 2(*c*) shows a circuit in which a 2-input OR gate circuit 121 is used as the delay element, and is arranged in such a manner that an L-length as to a first input terminal is made longer. In this case, since the OR gate circuit 121 does not function as the inverter and also the same signal merely passes through this OR gate circuit 121 while being delayed, the output terminal of this 2-input OR gate circuit 131 instead of the NOR gate circuit 13 is connected to the output terminal of the OR gate circuit 121. The output terminals of the AND gate circuit 3*r* and 3*b* are connected to both the input terminals of the OR gate circuit 131.

FIG. 2(*d*) shows a circuit in which a 2-input AND gate circuit 122 is used as the delay element, and is arranged in such a manner that an L-length as to a first input terminal is made longer. In this case, since the AND gate circuit 122 does not function as the inverter and also the same signal merely passes through this AND gate circuit 122 while being delayed, the output terminal of the 2-input OR gate circuit 131 instead of the NOR gate circuit 13 is connected to the output terminal of the AND gate circuit 122. The output terminals of the AND gate circuit 3*r* and 3*b* are connected to both the input terminals of the OR gate circuit 131.

Furthermore, as the delay element connected the gate of the drive transistor 2, other modified arrangements may be conceived by employing a resistor R, an LR delay circuit, a CR delay circuit, and a delay cable, and an ultrasonic delay element.

Also, the drive unit 11 may be arranged by employing other logic elements equivalent to the above-explained logic elements.

Figure 3:
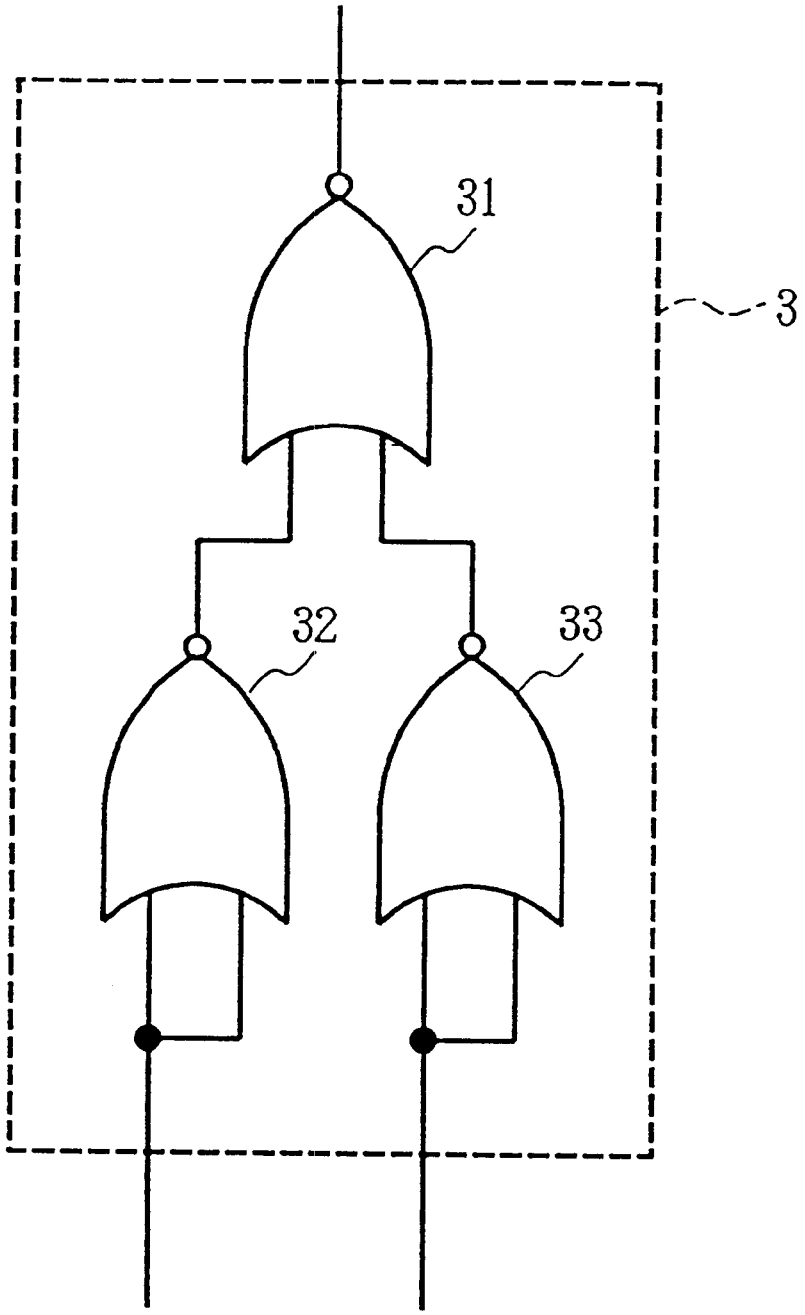
FIG. 3 is a circuit diagram for representing the structure of an equivalent circuit of an AND gate circuit provided in the thermal head driving IC of FIG. 1.

FIG. 3 represents an equivalent circuit of the AND gate circuits 3*r* and 3*b* (commonly indicated by reference numeral 3).

As shown in FIG. 3, 2-input NOR gate circuits 31, 32, 33 are employed, and while the output terminal of this NOR gate circuit 31 is used as an output terminal of the AND gate circuit 3, the input terminal of the NOR gate circuits 32 and 33 are connected to both input terminal of this AND gate circuit 3. To use both the NOR gate circuits 32 and 33 as an inverter, both the input terminals of the NOR gate circuit 32 are connected to each other to constitute a first input terminal of the AND gate circuit 3, and both input terminals of the NOR gate circuit 33 are connected to each other to constitute a second input terminal of the AND gate circuit 3. As a result, these circuit becomes equivalent to the 2-input AND gate circuit 3.

Figure 4:
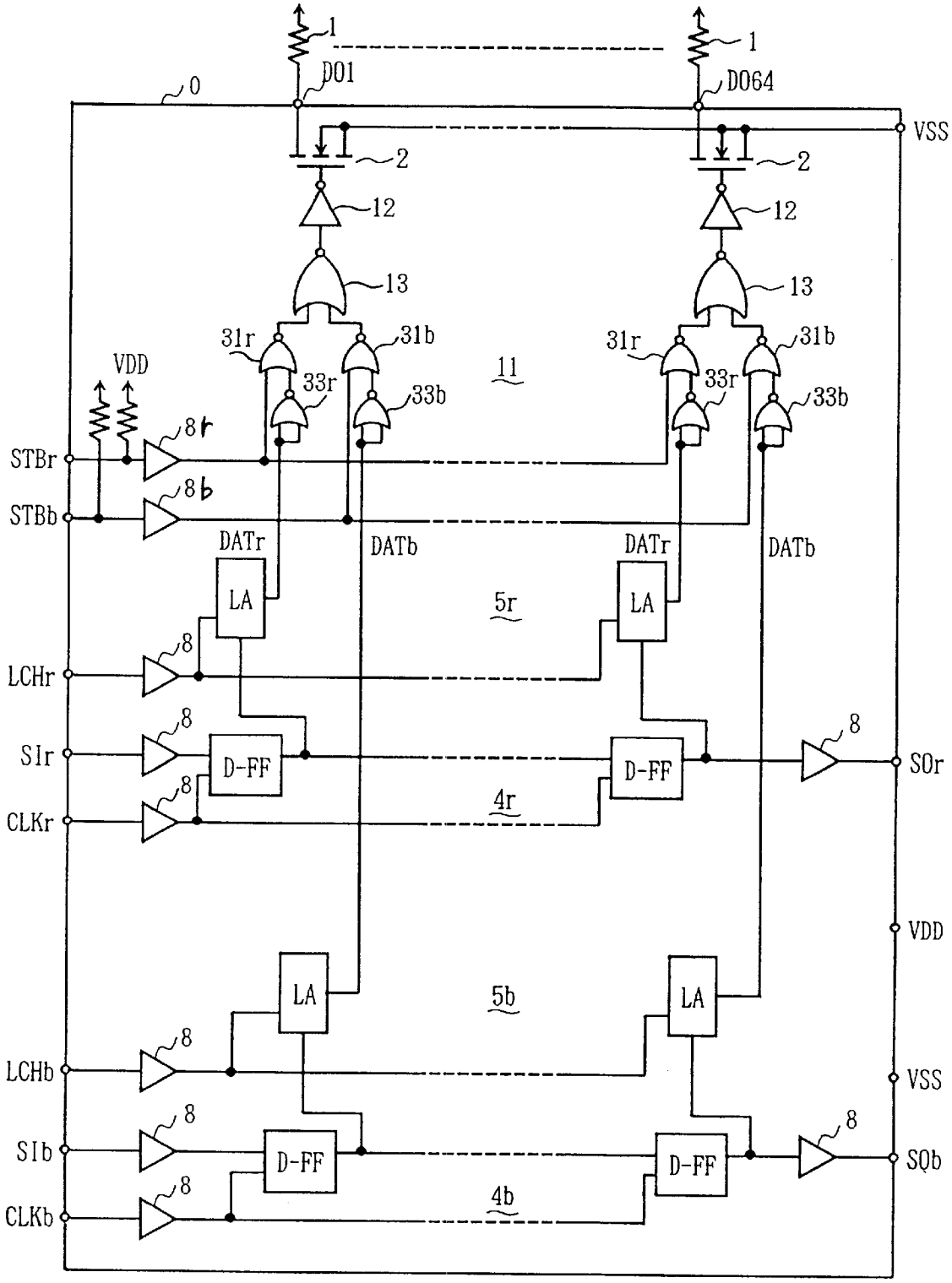
FIG. 4 is a schematic block diagram for indicating another circuit arrangement of the thermal head driving IC according to the embodiment.
Figure 5:
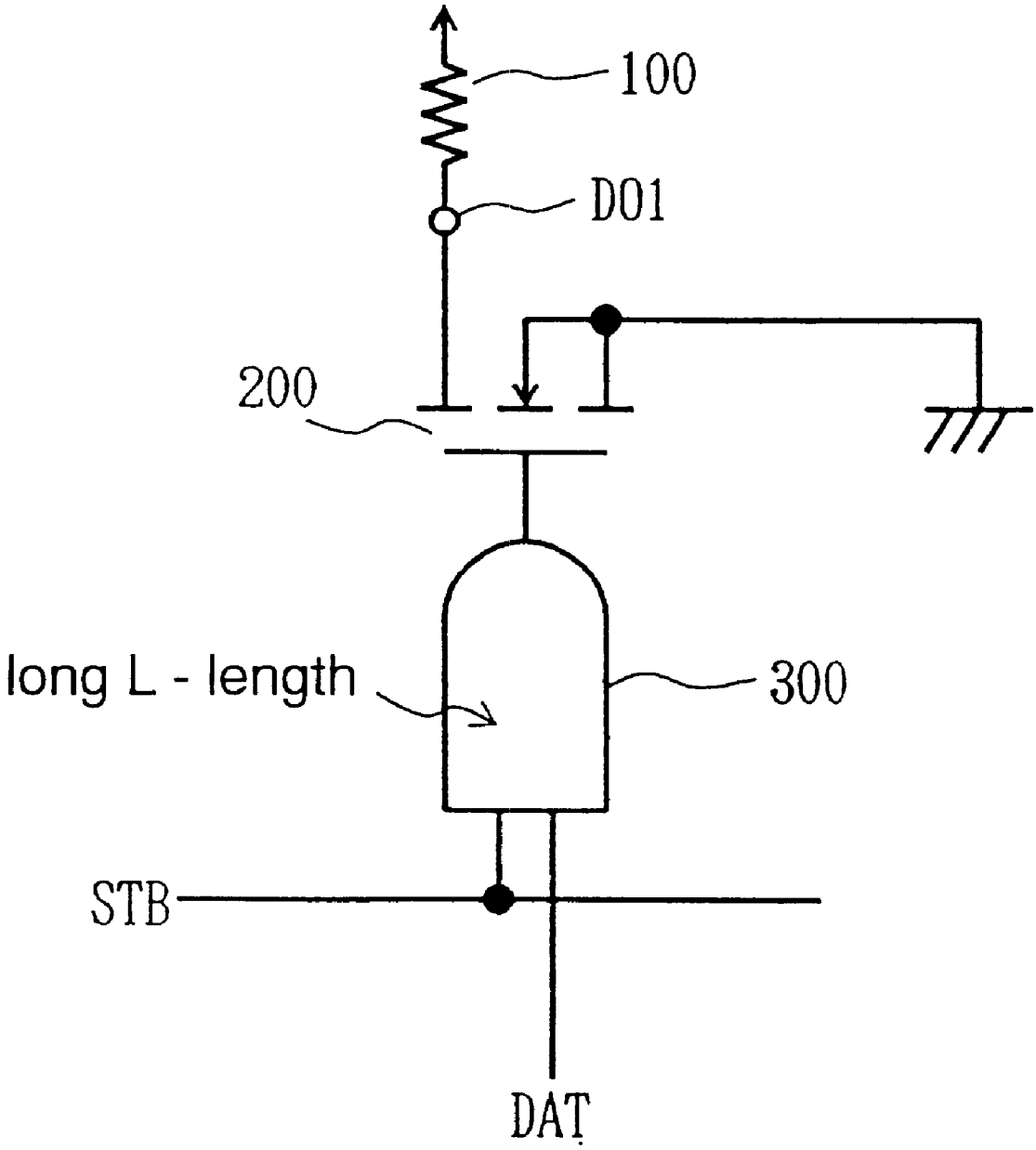
FIG. 5 shows a circuit diagram of the drive unit for ON/OFF-controlling a single heating resistive element employed in the conventional 1-color printing thermal head driving IC.
Figure 6:
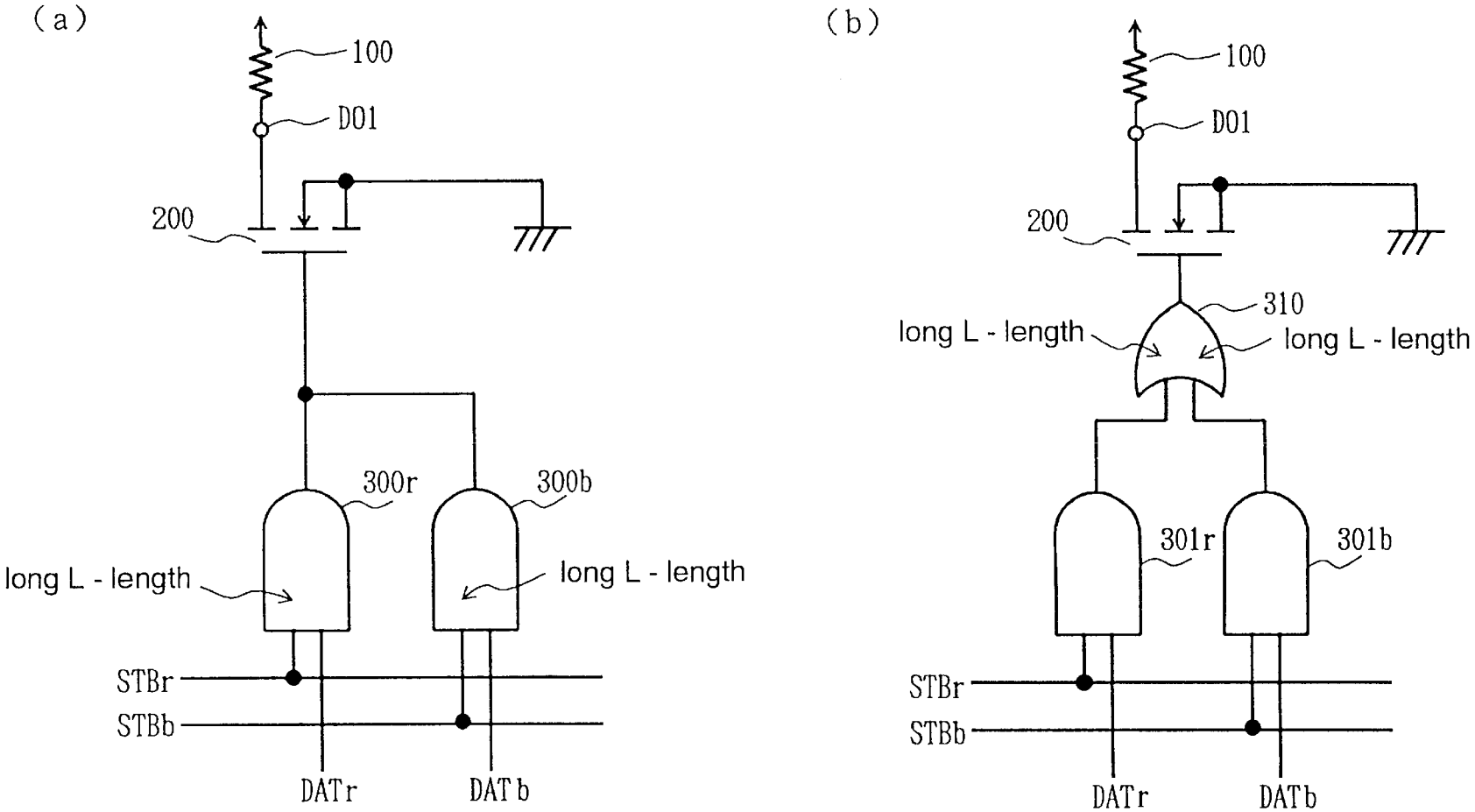
FIG. 6 is a circuit arrangement of another drive unit conceivable as the 2-color printing thermal head driving IC.

FIG. 4 indicates another circuit arrangement of a thermal head driving integrated circuit. It should also be noted that the same reference numerals shown in FIG. 1 will be employed as those for denoting the same, or similar circuit elements of this circuit arrangement shown in FIG. 4, and descriptions thereof are omitted, and also the different circuit portions will be mainly explained.

In the thermal head driving integrated circuit shown in FIG. 4, the circuit portion defined by the AND gate circuits 3*r*/3*b* and the inverter 7*r*/7*b* in FIG. 1 is replaced by equivalent circuit thereof.

In the case that the AND gate circuit 3 is constituted by employing three sets of NOR gate circuits 31 to 33 shown in FIG. 3, the NOR gate circuit 32 may function as an inverter. Thus, in the equivalent circuit of FIG. 4, both the NOR gate circuits 32*r*/32*b* and the inverters 7*r*/7*b* are omitted.

Then, in FIG. 4, buffers 8*r* and 8*b* are newly arranged instead of these inverters 7*r* and 7*b*. As a result, an element which is commonly used with the buffer 8 used in other circuits may be employed, so that the sorts of circuit elements may be reduced.

Furthermore, the two-color printing operations for the red and black data have been explained. The thermal head driving integrated circuit of the present invention may be similarly applied to other cases, for example, n-color printing operation and n-gradation printing operation.

Also, in this case, the drive transistor 2 is driven by using any one of the delay elements shown in FIG. 2, or other delay elements ("n" pieces of these delay elements, and "n" is preferably selected from 1). Then, in connection with n-color print data, "n" sets of the strobe signals STB, the AND gate circuits 3, the shift registers 4, and the latch circuits 5 are used. Instead of the 2-input NOR gate circuit 13 (in case of FIG. 1, FIG. 2(*a*), and FIG. 2(*b*)), the respective output terminals of "n" pieces of AND gate circuits 3 are connected to the respective input terminals of n-input NOR gate circuits. Otherwise, these output terminals are connected to the respective input terminals of an n-input OR gate circuit instead of the 2-input OR gate circuits 131 (in case of FIG. 2(*c*) and FIG. 2(*d*)).

As previously explained, even when the n-gradation printing operation and the n-color printing operation are carried out, the thermal head driving integrated circuit may be arranged by employing one delay element. Therefore, it is possible to avoid increasing of the chip size, and also to uniform the printing qualities in the respective bits.

In accordance with the present invention, since a total number of the delay means can be made smaller than "n" and these delay means delay the print data to supply the delayed print data to the drive transistor, the entire size of the integrated circuit can be reduced.

Also, since a single delay element is commonly used as to plural sorts of print data, the printing qualities as to the commonly used print data can be made uniform.

What is claimed is:

1. A thermal head driving integrated circuit for controlling energizing operations of a plurality of heating resistive elements in response to supplied print data used for energizing the heating resistive elements for an integer number "n" different durations to produce "n" different print types, the thermal head having a plurality of drive units, each for driving a respective one of the heating resistive elements, each of the drive units comprising:

a drive transistor for controlling the energizing operation of a respective heating resistive element in response to the supplied print data;

one or more delay elements, the number of delay elements being less than "n" and at least one, for delaying the print data and supplying the delayed print data to the drive transistor;

print data storing means for storing the supplied print data of each of the "n" print types; and print data supplying means for supplying print data stored in the corresponding print data storing means to the "n" delay elements.

2. A thermal head driving integrated circuit according to claim 1; wherein the drive transistor is an enhancement type FET and the delay element comprises a 1-input/1-output logic circuit having a channel length at an input stage thereof which is sufficiently long so that a transition in the print data does not cause a maximum rated voltage of the drive transistor to be exceeded.

3. An integrated circuit according to claim 1; wherein the delay element has a channel length at an input stage thereof set long enough so that a transition in the print data does not cause a maximum rated voltage of the drive transistor to be exceeded.

4. An integrated circuit according to claim 1; wherein the print data storing means comprises a shift register for transferring serially-supplied print data thereinto, and a latch unit for latching the print data stored in the shift register and supplying the latched print data to the print data supplying means for driving the drive transistor.

5. An integrated circuit according to claim 4; wherein the print data supplying means comprises a first logic gate for each of the "n" print types, each first logic gate having one input terminal for receiving the latched print data of one of the "n" types and a second input terminal for receiving a strobe signal for controlling printing of the one print type, so that the latched print data of the one print type is supplied to the corresponding delay element in response to a strobe signal having a given polarity.

6. An integrated circuit according to claim 5; wherein the print data supplying means further comprises a second logic gate for receiving outputs of the first logic gates and producing a single output based on outputs of the first logic gates.

7. An integrated circuit according to claim 6; wherein the one or more delay element comprises an inverter for inverting an output of the second logic gate circuit and having an input stage and an output stage, the input stage being formed with a longer channel length than the output stage.

8. An integrated circuit according to claim 7; wherein the first logic gates each comprise AND gates and the second logic gate comprises a NOR gate.

9. An integrated circuit according to claim 1; wherein an output of each of the one or more delay elements is connected directly to a gate of the drive transistor.

10. An integrated circuit according to claim 1; wherein the one or more delay elements comprise one or more inverters.

11. An integrated circuit according to claim 1; wherein the print data comprises a first set of print data for specifying the print type, and a second set of print data for controlling the duration of energization of the heating resistive element.

12. An integrated circuit according to claim 1; wherein the first set of print data comprises color data for specifying a color to be printed, and the second set of print data comprises strobe pulses for controlling the duration of energization of the respective heating resistive elements according to the color data.

13. An integrated circuit according to claim 1; wherein the print data types comprise plural gradations.

14. An integrated circuit according to claim 1; wherein the print data types comprise plural colors.

15. A drive circuit for driving a resistive heating element in a print head, comprising: a print data storage circuit for storing received print data; a drive transistor for driving the resistive heating element according to the print data; a print data supplying circuit for supplying the print data to the drive transistor; and a delay element interposed between the print data supplying circuit and the resistive heating element for delaying the output of the print data supplying circuit so that a transition in the print data does not cause a maximum rated voltage of the drive transistor to be exceeded, the delay element comprising an inverter having a channel length at an input stage which is longer than a channel length at an output stage thereof so that a transition in the print data does not cause a maximum rated voltage of the drive transistor to be exceeded.

16. A drive circuit for driving a resistive heating element in a print head, comprising: a print data storage circuit for storing received print data; a drive transistor for driving the resistive heating element according to the print data; a print data supplying circuit for supplying the print data to the drive transistor; and a delay element interposed between the print data supplying circuit and the resistive heating element for delaying the output of the print data supplying circuit so that a transition in the print data does not cause a maximum rated voltage of the drive transistor to be exceeded; wherein the print data is used to energize the resistive heating element for an integer number "n" different durations to produce "n" different print types; and wherein the delay element comprises one or more delay elements, the number of delay elements being less than "n".

17. A drive circuit for driving a resistive heating element in a print head, comprising: a print data storage circuit for storing received print data, the print data comprising a first print data value for specifying whether printing is to be performed by the resistive heating element and a second print data value for specifying a duration of energization of the resistive heating element; a drive transistor for driving the resistive heating element according to the print data; a print data supplying circuit for supplying the print data to the drive transistor, the print data supplying circuit comprising a logic circuit for performing a logical operation on the first and second print data values to produce one output bit based on the first and second print data values; and a delay element interposed between the print data supplying circuit and the resistive heating element for delaying the output of the print data supplying circuit so that a transition in the print data does not cause a maximum rated voltage of the drive transistor to be exceeded, the delay element comprising a logic circuit having one input and one output and having a channel length at an input stage which is sufficiently long so that a transition in the print data does not cause a maximum rated voltage of the drive transistor to be exceeded.

18. A thermal print head comprising: a plurality of resistive heating elements arranged on a support and being energizable for different durations to produce an integer number "n" different print types according to received print data used for controlling the duration of energization of the respective resistive heating elements for "n" different durations; a drive unit having drive transistors respectively connected to drive the resistive heating elements; a shift register unit for sequentially transferring serially-supplied print data thereinto; and a latch unit for latching the print data held in the shift register and supplying the latched print data to the drive unit for driving the drive transistors; wherein the drive unit has one or more delay elements, the number of delay elements being less than "n" but at least one, for delaying the print data from being supplied to the resistive heating elements to prevent a transition in the print data from causing a maximum rated voltage of the drive transistors to be exceeded.

19. A thermal print head according to claim 18; wherein the drive unit has a single delay element for each of the resistive heating elements for delaying each of the "n" types of print data from being supplied thereto.

20. A thermal print head according to claim 18; wherein the drive unit further comprises a plurality of first logic gates each for performing a logical operation on print data of each of the "n" print types for each of the resistive heating elements, each first logic gate having one input terminal for receiving the latched print data of one of "n" types and a second input terminal for receiving a strobe signal for controlling printing of the one print type, so that the latched print data of the one print type is supplied to the corresponding delay element in response to a strobe signal having a given polarity.

21. A thermal print head according to claim 20; wherein the drive unit further comprises a second logic gate for receiving outputs of the first logic gates for each resistive heating element and producing a single output based on outputs of the first logic gates.

22. A thermal print head according to claim 21; wherein the one or more delay elements comprise inverters for inverting an output of the second logic gate and having an input stage and an output stage, the input stage being formed with a longer channel length than the output stage.

23. A thermal print head according to claim 22; wherein the first logic gates each comprise AND gates and the second logic gate comprises a NOR gate.

* * * * *